United States Patent [19]

Egger

[11] 3,977,177

[45] Aug. 31, 1976

[54] ELECTRIC ALARM WATCH

[75] Inventor: Joseph Egger, Pforzheim, Germany

[73] Assignee: Timex Corporation, Waterbury, Conn.

[22] Filed: May 27, 1975

[21] Appl. No.: 581,390

[30] Foreign Application Priority Data

July 12, 1974 Germany ..... 2433560

[52] U.S. Cl. ..... 58/57.5; 58/28 B; 58/38 R; 58/91

[51] Int. Cl.[2] ..... G04B 23/12; G04C 3/04; G04C 21/34; G04B 39/00

[58] Field of Search ..... 58/28 A, 28 B, 28 R, 58/38, 57.5; 340/388

[56] References Cited

UNITED STATES PATENTS

| | | | |
|---|---|---|---|
| 3,318,084 | 5/1967 | Patrick | 58/38 |
| 3,759,029 | 9/1973 | Komaski | 58/38 |
| 3,863,437 | 2/1975 | Barth et al. | 58/57.5 |

*Primary Examiner*—E. S. Jackmon

[57] ABSTRACT

The invention concerns, in particular, an electric wristwatch having an alarm device. In accordance with the invention, the impulses produced for driving the electric movement in the watch are, also, used for operating or controlling the signal-source to the alarm device. For example, in an electric quartz watch the impulses can be extracted from any chosen stage of the frequency divider and after amplificaton can be used to control the signal-source to a buzzer. It is the low pulse repetition frequency of the driving impulses, in balance wheel type watches, which leads to a distinctive signal.

8 Claims, 4 Drawing Figures

ELECTRIC ALARM WATCH

BACKGROUND OF THE INVENTION

Figure 1:
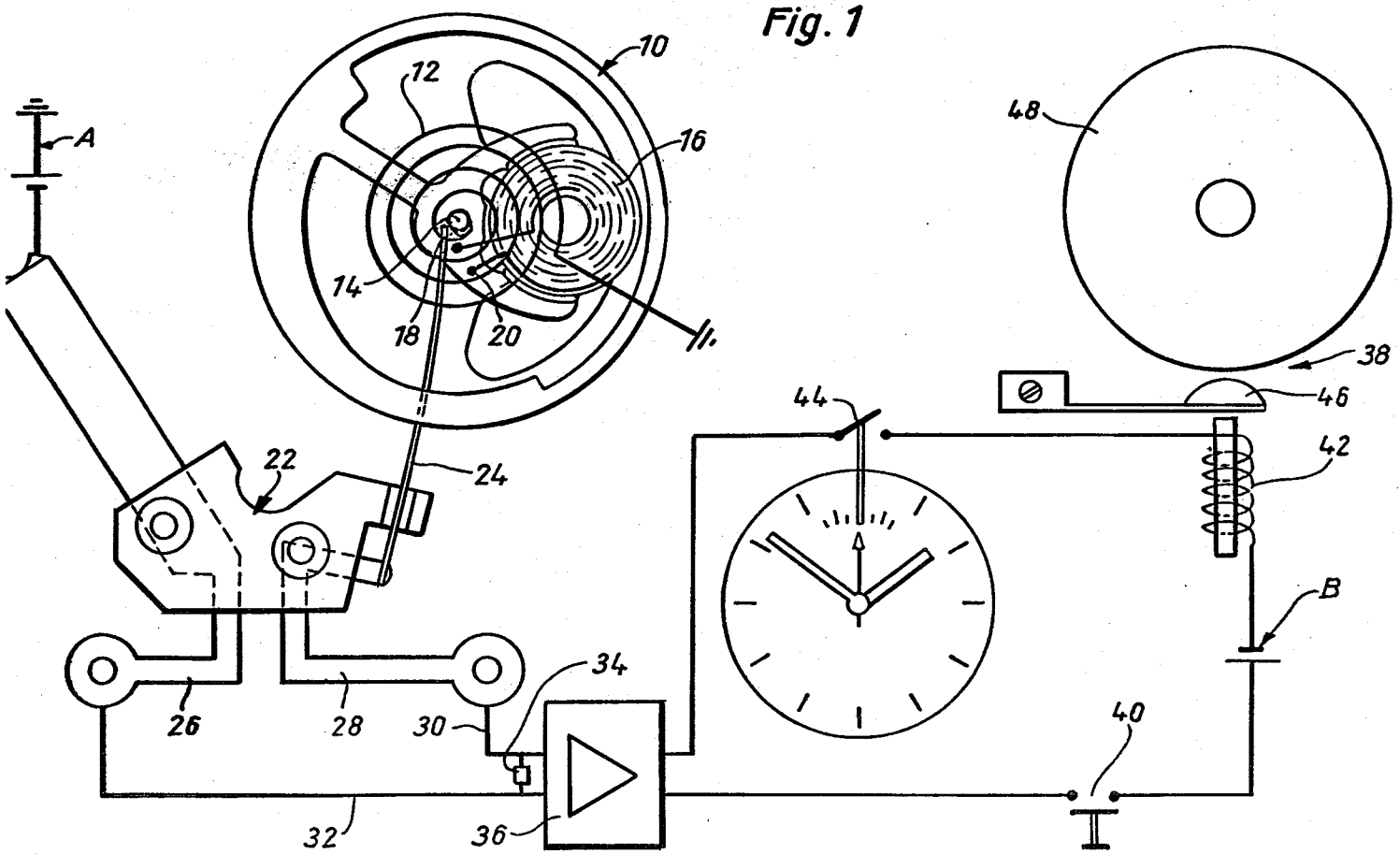

The invention concerns an electric alarm watch, particularly an electric wristwatch with alarm device, with an electric movement driven by drive impulses, as well as an electric signal source.

Electric wristwatches of this type are known (see for instance DT-OS 1, 673, 697 and the magazine "Die Uhr", No. 13, 1972, page 100) with the electric signal source consisting of a battery, an electric-excited buzzer and the watch crystal; part of the buzzer is a leaf spring excited in its natural frequency which strikes against a pivot fastened at the watch crystal and thereby causes the watch crystal to vibrate.

This known construction has several disadvantages: in the first place it is sumptuous in view of the number of parts, because a buzzer of this type requires two coils. The buzzer must be of very accurate construction and needs adjustment, so that the leaf spring can be excited in its natural frequency. Finally, the small dimensions of a wristwatch condition relatively high frequencies of the leaf spring, so that this known wristwatch dispenses a relatively high-frequency sound which is often not heard.

The object of the invention is to construct a watch of the type mentioned at the beginning to be of simpler construction than the previously described, known type. This problem is solved in accordance with the invention by the fact that the signal source can be applied to voltage drained off the drive impulses or the alarm device can be controlled by impulses from a frequency divider in an electronic watch such as is shown in U.S. Pat. No. 3,540,209 issued Nov. 17, 1970 to N. C. Zatsky and assigned to same assignee as the present invention. Disregarding synchronous watches, impulses are produced for the drive of the electric movement in all electric watches, these impulses, in accordance with the invention, are also used for operating the signal source. One can, for instance, in an electric quartz watch extract impulses at any chosen step of the frequency divider, switches after the quartz, which after corresponding amplifying can be used for operating the signal source. This can be of simple construction, since for instance only one single coil, a permanent magnet and a vibrating organ will suffice for producing vibrations for the alarm signal. The basic idea of the invention can also be applied to electric movements with a balance wheel by amplifying the drive impulses for the balance wheel, which have for instance a pulse repetition frequency of 6 Hz, and connecting same to a suitable signal source. It is the low pulse repetition frequency with balance wheel watches which leads to a distinctive signal, and it is a special characteristic of a preferred type of construction in accordance with the invention that impulses with a pulse repetition frequency of approximately 5 – 10 Hz, particularly 6 Hz, can be applied to the signal source. This is quite contrary to the known watches of the type mentioned, whose alarm signal is always of considerably higher frequency.

In view of the invention a simplification in construction over prior art watches can be achieved, particularly with electric balance wheel watches having a drive coil on the balance wheel and a stationary permanent magnet, thereby that the permanent magnet for the drive of the movement is also a part of the signal source, which means saving a separate permanent magnet for operating the signal source. This will also allow a very flat watch construction, which is of special importance with wristwatches.

With a preferred type of construction of the invention, the watch crystal is included in the electromechanical transducer system, as is known, and the thinnest construction conceivable is achieved by arranging in the signal source the permanent magnet of the watch movement between a balance wheel equipped with coil and a vibrator equipped with coil, which is rotary positioned around an axis running vertically to the watch crystal and strikes against stops formed at the watch crystal or fastened to this.

Figure 2:
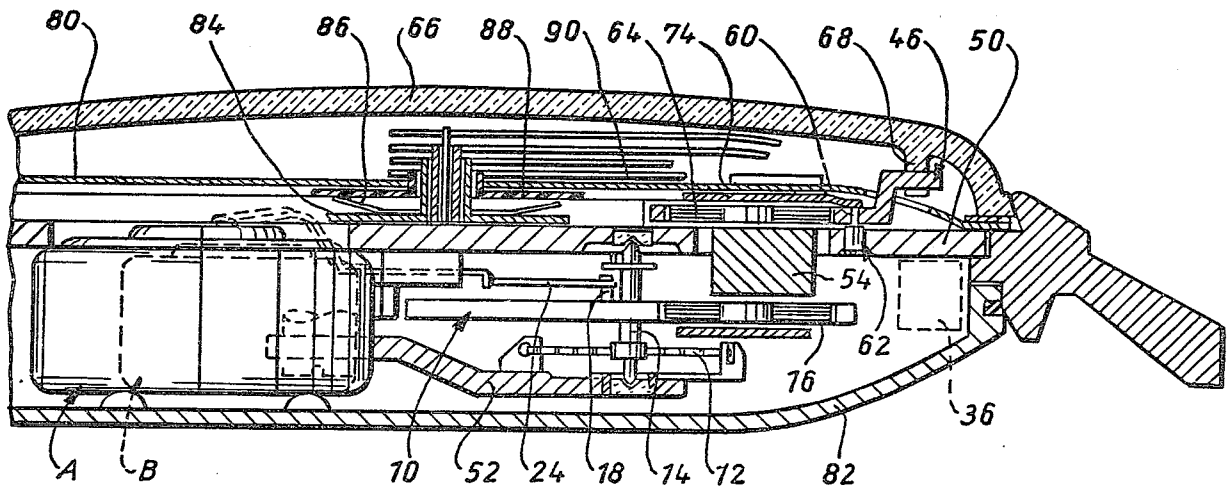
Figure 3:
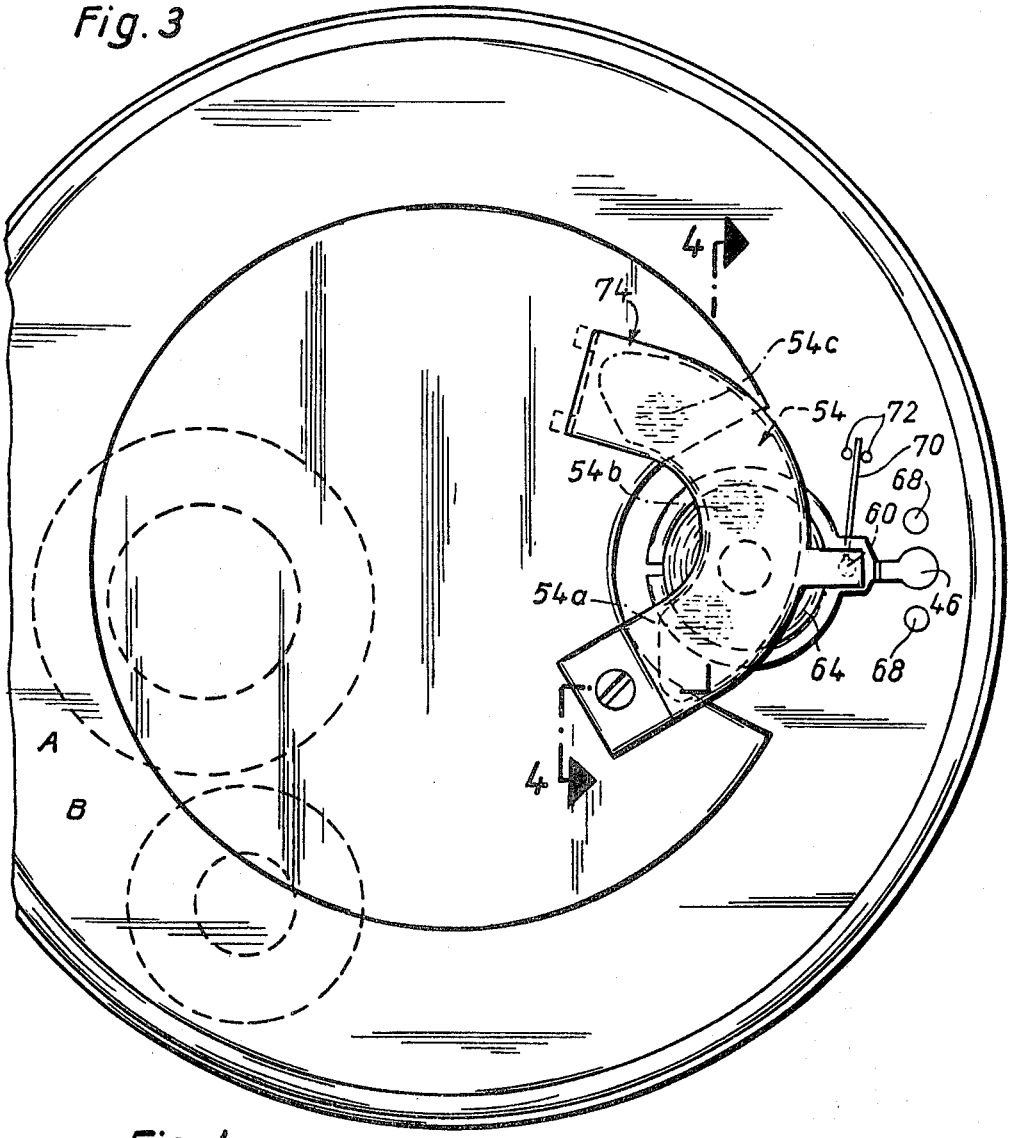
Figure 4:
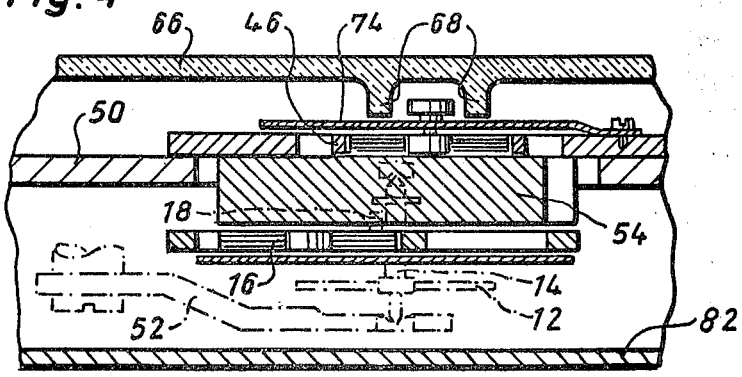

Further characteristics, details and advantages of the invention can be seen from the attached claims and/or the following description and the attached graphic illustration of a preferred type of construction of a watch in accordance with the invention; shown are:

FIG. 1 a schematic illustration of the circuit for the watch;

FIG. 2 a vertical section through the construction in form of a wristwatch, showing only those parts which are essential in connection with the invention;

FIG. 3 a schematic top view of this watch, again omitting those parts which are not essential for demonstrating the invention, and FIG. 4 a section per line 4 — 4 of FIG. 3.

FIG. 1 shows a balance wheel, as a unit marked 10, with hairspring 12, axis 14 and a drive coil 16 fastened thereto, whose ends are connected in the first place to a contact pin 18 which is insulated and fixed to the balance wheel body and secondly to mass at marking 20, i.e. to the actual balance wheel body.

Insulated and arranged to a front frame 22 is a contact spring 24 against whose free end the contact pin 18 comes to rest when the balance wheel oscillates. The drive circuit for the balance wheel 10 is closed via conductor paths 26 and 28, arranged and insulated at the front frame, as well as conductors 30 and 32, a resistor 34 and a battery A and the mass of the watch frame to which the plus pole of the battery is connected. Drive impulses in this drive circuit will appear corresponding to the balance wheel frequency when the contact pin 18 touches the contact spring 24.

The voltage drop occurring during these drive impulses at resistor 34 is amplified by an amplifier 36, so that impulses drained off the drive impulses are used for operating a signal source, which as a unit is marked 38. A second battery B is planned for this purpose, whose one pole is connected to the amplifier 36 via a stop switch 40, particularly a manual switch, and whose other pole is connected to the amplifier 36 via a coil 42, equipped with a core, of the signal source 38 and an alarm time switch 44 operated by the watch. The coil 42 excites a vibrator 46, arranged at the watch frame, in rhythm with the drive impulses of the balance wheel 10, and this vibrator strikes against a sound-producing organ 48.

FIGS. 2 – 4 show an electric wristwatch constructed in accordance with the invention. As far as possible the same reference markings were used as in FIG. 1.

Arranged to the balance wheel 10, which is positioned between a front frame 50 and a bridge 52 of a watch frame is an arched permanent magnet 54, which is magnetized in such a way that it has on each side 3 poles of different alternating polarity, which were marked as 54*a* to 54*c* in FIG. 3. This enables to drive the drive coil 16 of the balance wheel 10, and thereby the latter itself, with impulses of different polarity in both directions.

Arranged above the permanent magnet 54, fastened in the front frame 50, is a double-armed vibrator 46, which is swivel positioned around an axis 60 vertical to the front frame 50 at marking 62 in the front frame 50, and in accordance with FIG. 2 carries to the left of the bearing a coil 64 and to the right of the bearing is edged in such a way that it can strike against two pivots 68 formed at the watch crystal 66. Fastened in the center of the vibrator is a return-spring 70, whose free end is prevented from swinging aside by two pins 72 of the front frame 50. For the purpose of concentrating the magnetic flux, a magnetic shunt 74 fastened to the front frame 50 is arranged over the coil 64 and the poles 54*a* to 54*c* of the permanent magnet 54.

As can be seen, in particular from FIG. 2, the construction of the elements for the drive of the signal source required additionally to the unusual electric balance wheel watch is exceptionally flat, so that they can be accommodated between the front frame 50 and a dial 80.

It is also worthwhile mentioning that it is practical for the coil 64 of the vibrator 46 of the signal source to have the same diameter as the drive coil 16 of the balance wheel 10 of the movement. Indicated in FIG. 2 is also that point, where the amplifier 36, preferably in the form of an integrated circuit, can be accommodated, that is between front frame 50 and the back 82 of the watch.

To complete the illustration, indicated in FIG. 2 are means for the construction of the alarm-time-switch 44 in FIG. 1: fastened on an hour wheel 84 is a contact spring 86 which bridges points of contact, which are not shown, at an alarm-time-wheel 88 made of insulating material, when the alarm time is reached, which was set by the alarm-time-wheel and indicated by the alarm-time-hand 90 connected to this. Then, with the closed stop-switch 40 (see FIG. 1) the circuit between amplifier 36, battery B and coil 64 of the vibrator 46 is closed, so that the vibrator oscillates in rhythm with the balance wheel 10 between the pivots 68 of the watch crystal and thereby excites the watch crystal which operates as a membrane.

I claim:

1. An alarm wristwatch, the combination comprising:

means for providing electrical control pulses;

an electromechanical oscillator means having a balance wheel unit with a balance drive coil affixed thereto which cooperates with a fixed permanent magnet;

alarm means having a switch device connected in series to an energy cell and settable to any particular time for alarm purposes, said switch device being also connected to the watch for activation thereby when the particular time occurs, a vibrator having affixed thereto a vibrator drive coil which is connected in series to said switch device, circuit means connected in series with said switch device and being controlled by said electrical control pulses for causing a pulsating current input to said vibrator drive coil which in response to said pulsating current input and in cooperation with said fixed permanent magnet causes said vibrator to vibrate against a watch crystal to produce an audible sound.

2. An alarm wristwatch as in claim 1, wherein:

the electrical control pulses are coupled to said balance drive coil and causes said balance wheel unit to oscillate at a frequency substantially equal to the frequency at which said vibrator vibrates.

3. An alarm wristwatch as in claim 2, wherein:

the electrical control pulses has a frequency between 5 and 10 Hz.

4. An alarm wristwatch as in claim 1, wherein:

said circuit means being an amplifier the output of which being connected in series with said switch device.

5. An alarm wristwatch as in claim 1, wherein:

said circuit means being an electronic switch being controlled to open and close in response to said electrical control pulses.

6. An alarm wristwatch as in claim 1, wherein:

said fixed permanent magnet being arranged between the balance wheel unit and the vibrator.

7. An alarm wristwatch as in claim 1, wherein:

the balance drive coil and the vibrator drive coil having approximately the same diameter.

8. An alarm wristwatch as in claim 1, wherein:

said vibrator being vibrated strikes against a stop formed at the watch crystal to produce an audible sound.

* * * * *